US011731179B2

(12) United States Patent
Xu et al.

(10) Patent No.: US 11,731,179 B2
(45) Date of Patent: Aug. 22, 2023

(54) STEEL STRIP COILING TEMPERATURE CONTROL METHOD, DEVICE FOR THE SAME AND STEEL STRIP PROCESSING SYSTEM

(71) Applicant: SHOUGANG JINGTANG IRON & STEEL CO., LTD., Hebei (CN)

(72) Inventors: Fang Xu, Hebei (CN); Hongbo Qin, Hebei (CN); Jinfang Shi, Hebei (CN); Shuang Huang, Hebei (CN); Dongning Li, Hebei (CN); Kai Li, Hebei (CN); Liang Hu, Hebei (CN); Tong Chen, Hebei (CN); Wei Zheng, Hebei (CN); Junyin Wang, Hebei (CN); Lingfeng Chen, Hebei (CN); Haiwei Xu, Hebei (CN); Shengguo Cui, Hebei (CN); Jinhua Wang, Hebei (CN); Changqing Cao, Hebei (CN); Zhijun Wei, Hebei (CN)

(73) Assignee: SHOUGANG JINGTANG IRON & STEEL CO., LTD., Hebei (CN)

( * ) Notice: Subject to any disclaimer, the term of this patent is extended or adjusted under 35 U.S.C. 154(b) by 386 days.

(21) Appl. No.: 17/016,381

(22) Filed: Sep. 10, 2020

(65) Prior Publication Data

US 2021/0031252 A1 Feb. 4, 2021

Related U.S. Application Data

(63) Continuation of application No. PCT/CN2019/116503, filed on Nov. 8, 2019.

(30) Foreign Application Priority Data

Jul. 31, 2019 (CN) ..... 201910701867.2

(51) Int. Cl.
*B21B 37/74* (2006.01)
*B21B 45/02* (2006.01)
(Continued)

(52) U.S. Cl.
CPC ..... *B21B 37/74* (2013.01); *B21B 45/0209* (2013.01); *B21C 47/003* (2013.01); *B21C 47/02* (2013.01); *C21D 9/573* (2013.01)

(58) Field of Classification Search
None
See application file for complete search history.

(56) References Cited

U.S. PATENT DOCUMENTS

2021/0031252 A1* 2/2021 Xu ..... C21D 9/573

FOREIGN PATENT DOCUMENTS

CN 108446454 A 8/2018

* cited by examiner

*Primary Examiner* — Scott R Kastler
(74) *Attorney, Agent, or Firm* — Syncoda LLC; Feng Ma

(57) ABSTRACT

The present disclosure discloses a steel strip coiling temperature control method, a steel strip coiling temperature control device and a steel strip processing system, which relate to the technical field of steel strip production. The method comprises: seeking a corresponding speed compensation coefficient according to a target thickness of the steel strip and a target temperature parameter; seeking a corresponding speed gain coefficient from a second correspondence table according to a steel strip speed; correcting the steel strip speed based on the speed compensation coefficient and the speed gain coefficient to obtain a corrected steel strip speed; and adjusting a cooling efficiency of a laminar flow cooling apparatus according to the corrected steel strip speed. With the method, the cooling efficiency of the laminar flow cooling apparatus can be dynamically adjusted according to the steel strip speed, thereby solving the problem that that there is a great difference in coiling temperature
(Continued)

between a tail section of the steel strip and a front section of the steel strip caused by the steel strip throwing process, and reducing the amount of cutting loss of the steel strip.

10 Claims, 4 Drawing Sheets

(51) Int. Cl.

| | |
|---|---|
| ***B21C 47/00*** | (2006.01) |
| ***B21C 47/02*** | (2006.01) |
| ***C21D 9/573*** | (2006.01) |

STEEL STRIP COILING TEMPERATURE CONTROL METHOD, DEVICE FOR THE SAME AND STEEL STRIP PROCESSING SYSTEM

CROSS-REFERENCE OF RELATED APPLICATIONS

This application claims priority of Chinese Patent Application No. 201910701867.2, filed with the Chinese Patent Office on Jul. 31, 2019, which is incorporated herein by reference in its entirety.

TECHNICAL FIELD

The present application relates to the technical field of steel strip production, and in particular, to a steel strip coiling temperature control method, a steel strip coiling temperature control device and a steel strip processing system.

BACKGROUND OF THE INVENTION

In the continuous hot rolling production line, it is a difficult problem in controlling a coiling temperature to ensure a uniform coiling temperature for the whole length of a steel strip, especially for a thin steel strip. Because a speed of a steel strip will change rapidly during a steel strip throwing process, the speed of a tail section of the steel strip passing through a cooling zone has a certain deviation compared with the speed of a front section of the steel strip, which leads to a problem that a coiling temperature of the tail section of the steel strip is different from a coiling temperature of the front section of the steel strip.

In the prior art, a cooling efficiency of a cooling apparatus is usually adjusted according to a thickness of a steel strip and a final rolling temperature to achieve the purpose of controlling a coiling temperature of the steel strip. However, at present, various temperature models cannot accurately describe the precise relationship between the speed change of a steel strip and the laminar flow cooling efficiency during the steel strip throwing process, and have a low adaptability to speed changes, which cannot effectively compensate for the effect of the speed change caused by a steel strip throwing process on the coiling temperature.

SUMMARY OF THE INVENTION

The present disclosure provides a steel strip coiling temperature control method, a steel strip coiling temperature control device and a steel strip processing system, solving the problems in the prior art that there is a great difference in coiling temperature between a tail section of a steel strip and a front section of the steel strip caused by the steel strip throwing process.

In order to achieve the aforementioned object, the present disclosure adopts the following technical solutions:

In a first aspect, one or more embodiments of the present disclosure provide a steel strip coiling temperature control method used in a laminar flow cooling apparatus. The laminar flow cooling apparatus is configured with a first correspondence table and a second correspondence table, wherein the first correspondence table is configured with speed compensation coefficients corresponding to target thicknesses of the steel strip and target temperature parameters, and the second correspondence table is configured with speed gain coefficients corresponding to steel strip speeds. The steel strip coiling temperature control method comprises: seeking a corresponding speed compensation coefficient from the first correspondence table according to a target thickness of the steel strip and a target temperature parameter; wherein the target temperature parameter comprises a target final rolling temperature and a coiling temperature; seeking a corresponding speed gain coefficient from the second correspondence table according to a steel strip speed; correcting the steel strip speed based on the speed compensation coefficient and the speed gain coefficient to obtain a corrected steel strip speed; and adjusting a cooling efficiency of the laminar flow cooling apparatus according to the corrected steel strip speed.

In some embodiments of the present disclosure, before the step of correcting the steel strip speed based on the speed compensation coefficient and the speed gain coefficient, the method further comprises: comparing the target thickness of the steel strip with a predetermined thickness threshold; performing the step of correcting the steel strip speed based on the speed compensation coefficient and the speed gain coefficient if the target thickness of the steel strip is less than or equal to the predetermined thickness threshold to obtain the corrected steel strip speed; taking the steel strip speed as the corrected steel strip speed if the target thickness of the steel strip is greater than the predetermined thickness threshold.

In some embodiments of the present disclosure, the step of seeking a corresponding speed compensation coefficient from the first correspondence table according to a target thickness of the steel strip and a target temperature parameter comprises: determining a grade of thickness to which the target thickness of the steel strip belongs according to a corresponding relationship between a predetermined target strip thicknesses of the steel strip and a grade of thickness; calculating a temperature difference value between the target final rolling temperature and the coiling temperature; determining a grade of temperature difference value corresponding to the target temperature parameter according to a corresponding relationship between the predetermined temperature difference values and the grade of temperature difference values; and determining the speed compensation coefficient according to the grade of thickness and the grade of temperature difference value.

In some embodiments of the present disclosure, the step of seeking a corresponding speed gain coefficient from the second correspondence table according to the steel strip speed comprises: obtaining a steel strip speed when a tail section of the steel strip reaches a F1 stand; and the F1 stand is the first roller in a precision rolling apparatus through which the steel strip passes; and seeking the speed gain coefficient corresponding to the steel strip speed when the tail section of the steel strip reaches the F1 stand from the second correspondence table.

In some embodiments of the present disclosure, the step of correcting the steel strip speed based on the speed compensation coefficient and the speed gain coefficient comprises: taking a product of the speed compensation coefficient and the speed gain coefficient as a speed correction coefficient; and calculating based on the speed correction coefficient and the steel strip speed to obtain the corrected steel strip speed.

In some embodiments of the present disclosure, the laminar flow cooling apparatus is further configured with a third correspondence table, and the third correspondence table is configured with cooling efficiency parameters corresponding to the target thicknesses of the steel strip, the target temperature parameters, and the steel strip speeds. The step of adjusting a cooling efficiency of the laminar flow cooling apparatus according to the corrected steel strip speed comprises: seeking a corresponding cooling efficiency parameter from the third correspondence table according to the corrected steel strip speed, the target thickness of the steel strip and the target temperature parameter; and adjusting a cooling water emission load of the laminar flow cooling apparatus according to the cooling efficiency parameter.

In a second aspect, one or more embodiments of the present disclosure provide a steel strip coiling temperature control device used in a laminar flow cooling apparatus. The laminar flow cooling apparatus is configured with a first correspondence table and a second correspondence table, wherein the first correspondence table is configured with speed compensation coefficients corresponding to target thicknesses of the steel strip and target temperature parameters; and the second correspondence table is configured with speed gain coefficients corresponding to steel strip speeds. The steel strip coiling temperature control device comprises: a first seeking module configured to seek a corresponding speed compensation coefficient from the first correspondence table according to a target thickness of the steel strip and a target temperature parameter, and the target temperature parameter comprises a target final rolling temperature and a coiling temperature; a second seeking module configured to seek a corresponding speed gain coefficient from the second correspondence table according to a steel strip speed; a correction module configured to correct the steel strip speed based on the speed compensation coefficient and the speed gain coefficient to obtain a corrected steel strip speed; and an adjustment module configured to adjust a cooling efficiency of the laminar flow cooling apparatus according to the corrected steel strip speed.

In some embodiments of the present disclosure, the device further comprises a determination module. The determination module is configured for: comparing the target thickness of the steel strip with a predetermined thickness threshold; performing the step of correcting the steel strip speed based on the speed compensation coefficient and the speed gain coefficient if the target thickness of the steel strip is less than or equal to the predetermined thickness threshold to obtain the corrected steel strip speed; and taking the steel strip speed as the corrected steel strip speed if the target thickness of the steel strip is greater than the predetermined thickness threshold.

In some embodiments of the present disclosure, the laminar flow cooling apparatus is further configured with a third correspondence table. The third correspondence table is configured with cooling efficiency parameters corresponding to target thicknesses of the steel strip, target temperature parameters and strip rolling speeds. The adjustment module is configured for: seeking a corresponding cooling efficiency parameter from the third correspondence table according to the corrected steel strip speed, the target thickness of the steel strip and the target temperature parameter; and adjusting a cooling water emission load of the laminar flow cooling apparatus according to the cooling efficiency parameter.

In a third aspect, one or more embodiments of the present disclosure further provide a steel strip processing system, comprising a steel strip precision rolling apparatus, a laminar flow cooling apparatus, and a steel strip coiling apparatus. The laminar flow cooling apparatus is provided between the steel strip precision rolling apparatus and the steel strip coiling apparatus, and is configured to cool a steel strip processed by the steel strip precision rolling apparatus; wherein the laminar flow cooling apparatus comprises a storage and a processor. The storage is configured to store a computer program, and the processor is configured to load and execute the computer program so as to enable the laminar flow cooling apparatus to perform the steel strip coiling temperature control method as described above.

Compared with the prior art, the steel strip coiling temperature control method provided in one or more embodiments of the present disclosure have at least the following technical effects or advantages:

With the steel strip coiling temperature control method in one or more embodiments of the present disclosure, a speed compensation coefficient is determined according to a target thickness of the steel strip, a target final rolling temperature and a target coiling temperature; a speed gain coefficient is determined according to a steel strip speed; then the steel strip speed is corrected according to the speed compensation coefficient and the speed gain coefficient to obtain a corrected steel strip speed; and finally a cooling efficiency of the laminar flow cooling apparatus is adjusted according to the corrected steel strip speed.

With this method in one or more embodiments of the present disclosure, the steel strip speed can be corrected in combination with various factors including a target thickness of the steel strip, a target final rolling temperature, a coiling temperature, a steel strip speed and the like, and then the cooling efficiency of the laminar flow cooling apparatus can be dynamically adjusted according to the corrected steel strip speed so as to solve the problems that there is a great difference in coiling temperature between a tail section of a steel strip and a front section of the steel strip caused by a steel strip throwing process, thereby reducing an amount of cutting loss of the steel strip.

BRIEF DESCRIPTION OF THE DRAWINGS

In order to more clearly explain the technical solutions in the embodiments of the present disclosure, the drawings used in the description of the embodiments will be briefly introduced in the following. Obviously, the drawings in the following description only represent some embodiments of the present disclosure. For those of ordinary skill in the art, other drawings can also be obtained according to these drawings without paying any creative work.

REFERENCE NUMERALS IN THE FIGURES ARE LISTED AS BELOW

10—precision rolling apparatus; 20—laminar flow cooling apparatus; 21—storage; 22—storage controller; 23—processor; 30—coiling apparatus; 70—steel strip coiling temperature control device; 701—first seeking module;

702—second seeking module; 703—correction module; 704—adjustment module; 705—determination module.

DETAILED DESCRIPTION OF THE INVENTION

Embodiments of the present disclosure provide a steel strip coiling temperature control method, a steel strip coiling temperature control device and a steel strip processing system, solving the problems in the prior art that there is a great difference in coiling temperature between a tail section of a steel strip and a front section of the steel strip caused by a steel strip throwing process.

In order to address the aforementioned problems, the general concept of the technical solutions of the embodiments of the present disclosure is as follows:

In some embodiments, a steel strip coiling temperature control method, applied to a laminar flow cooling apparatus, is provided. The laminar flow cooling apparatus is configured with a first correspondence table and a second correspondence table, wherein the first correspondence table is configured with speed compensation coefficients corresponding to target thicknesses of the steel strip and target temperature parameters, and the second correspondence table is configured with speed gain coefficients corresponding to steel strip speeds. The method comprises: seeking a corresponding speed compensation coefficient from the first correspondence table according to a target thickness of the steel strip and a target temperature parameter, wherein the target temperature parameter comprises a target final rolling temperature and a coiling temperature; seeking a corresponding speed gain coefficient from the second correspondence table according to a steel strip speed; correcting the steel strip speed based on the speed compensation coefficient and the speed gain coefficient to obtain a corrected steel strip speed; and adjusting a cooling efficiency of the laminar flow cooling apparatus according to the corrected steel strip speed.

In order to better understand the above technical solutions, one or more embodiments of the above technical solution will be described in detail in conjunction with accompanying drawings. In case of no conflicting, the following embodiments and the features of the present disclosure can be combined with each other.

It should be noted that in the description of the present disclosure, the terms "first", "second", etc. used herein are for distinguishing only and are not to be construed as indicating or implying relative importance.

Figure 1:
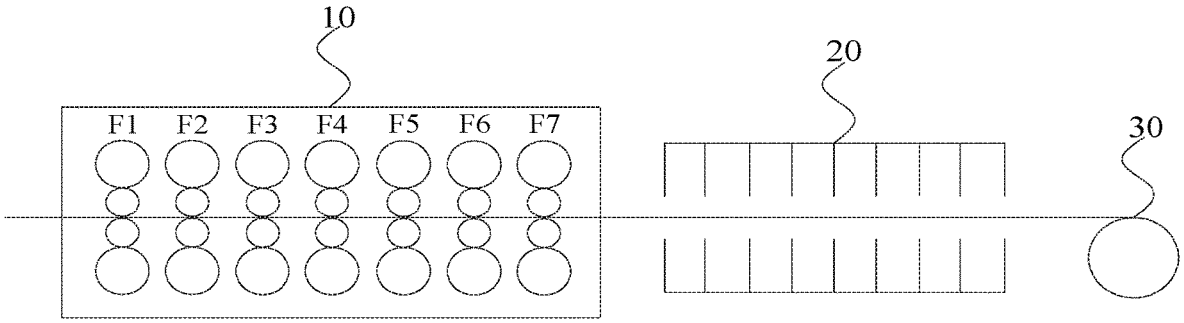
FIG. 1 is a schematic diagram showing a precision rolling-cooling-coiling process according to one or more embodiments of the present disclosure.

FIG. 1 is a schematic diagram showing a precision rolling-cooling-coiling process in a steel strip production line according to one or more embodiments of the present disclosure. In general, a steel strip processed by a precision rolling apparatus 10 has a temperature of 900° C.~950° C. (including 900° C.~920° C., 910° C.~930° C., 920° C.~940° C., 930° C.~950° C., etc.), and must be cooled to a temperature of 600° C.~650° C. (including 600° C.~620° C., 610° C.~630° C., 620° C.~640° C., 630° C.~650° C., etc.) in a few seconds through the laminar flow cooling apparatus 20 so as to be coiled. Further, during this process, in order to ensure product quality and performance of the steel strip, it is also necessary to ensure that the coiling temperature of the steel strip is kept within a certain range.

However, because the speed of the steel strip will change rapidly during the steel strip throwing process, there will be a large difference in the coiling temperature between a tail section of the steel strip and a front section of the steel strip, thereby resulting in that the steel strip is unable to meet relevant quality requirements, and thus increasing an amount of cutting loss of the steel strip.

The applicant found in the study course that the factors affecting the steel strip coiling temperature during the steel strip throwing process mainly include: a target thickness of the steel strip after it is processed by the precision rolling apparatus 10, a final rolling temperature of the steel strip when it leaves F7 roller, a rolling speed of the steel strip when it passes through a F1 stand, and a cooling efficiency of the laminar flow cooling apparatus 20. Among the above factors, the cooling efficiency of the laminar flow cooling apparatus 20 is mainly controlled based on the steel strip speed, the target thickness of the steel strip, the target final rolling temperature and the coiling temperature.

In some embodiments of the present disclosure, by correcting the steel strip speed during the steel strip throwing process, the cooling efficiency of the laminar flow cooling apparatus 20 can be dynamically adjusted, and the coiling temperature of the tail section of the steel strip can be controlled, thereby solving the problems that there is a great difference in coiling temperature between a tail section of a steel strip and a front section of the steel strip caused by a steel strip throwing process.

In some embodiments of the present disclosure, a steel strip coiling temperature control method is provided. The method of the present disclosure can be applied to the laminar flow cooling apparatus 20 in FIG. 1 to control the cooling efficiency of the laminar flow cooling apparatus 20 (specifically, to control a cooling water emission load of the laminar flow cooling apparatus 20 per unit time), and thus control the coiling temperature of the steel strip.

The steel strip coiling temperature control method provided by some embodiments of the present disclosure will be described in detail below with reference to FIG. 2.

Figure 2:
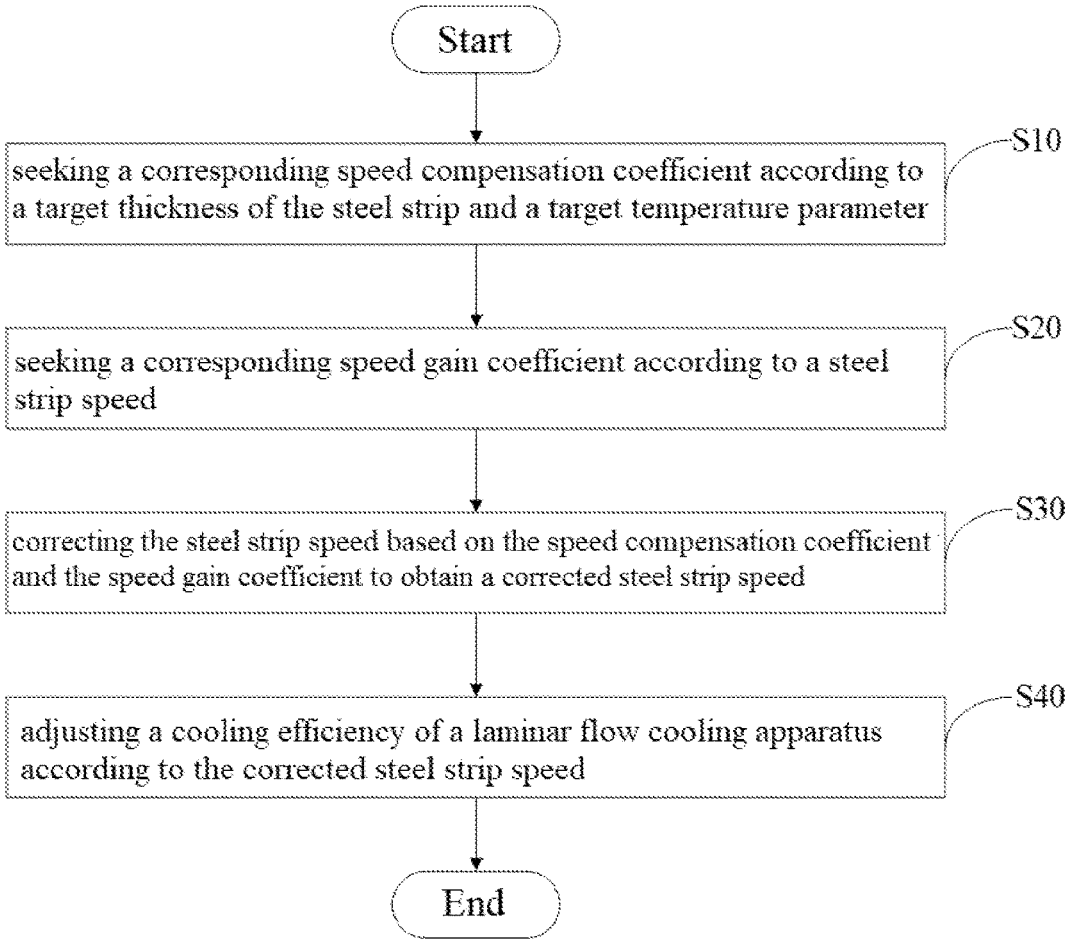
FIG. 2 is a schematic flowchart showing steps of a steel strip coiling temperature control method according to one or more embodiments of the present disclosure.

Referring to FIG. 2, the steel strip coiling temperature control method according to one or more embodiments of the present disclosure may comprise:

Step S10, seeking a corresponding speed compensation coefficient from a first correspondence table according to a target thickness of the steel strip and a target temperature parameter.

Step S20, seeking a corresponding speed gain coefficient from a second correspondence table according to a steel strip speed.

In some embodiments of the present disclosure, the target temperature parameter comprises a target final rolling temperature and a coiling temperature.

In some embodiments of the present disclosure, the target final rolling temperature and the coiling temperature may be obtained through processing parameters set in steel strip processing system, or may be obtained through real-time acquisition.

Figure 4:
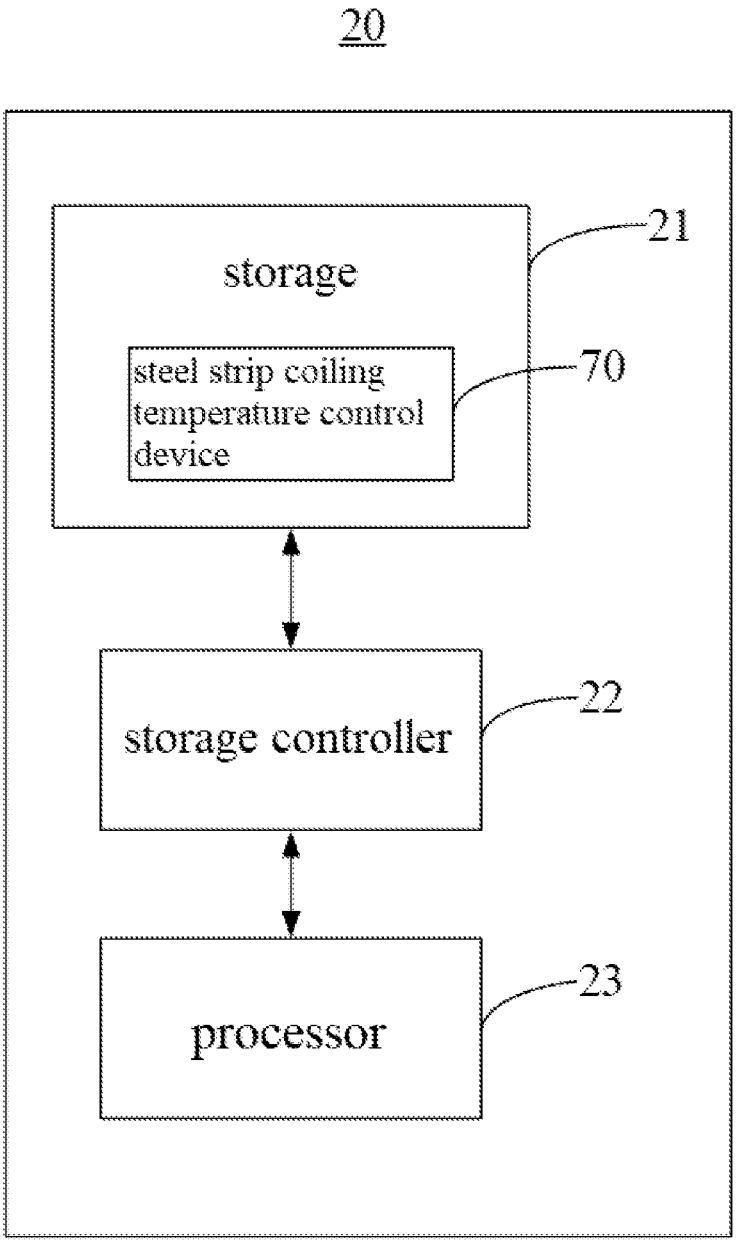
FIG. 4 is a schematic diagram showing the configuration of a laminar flow cooling apparatus according to one or more embodiments of the present disclosure.

In some embodiments of the present disclosure, the laminar flow cooling apparatus 20 may comprises a storage 21 and a processor 23 (referring to FIG. 4). The storage 21 is used to store a computer program, and the processor 23 is used to load and execute the computer program so as to enable the laminar flow cooling apparatus 20 to perform the steps of the method as provided in the present disclosure to realize the control of the steel strip coiling temperature.

In some embodiments of the present disclosure, before performing the above steps S10 and S20, it is necessary to establish in advance a corresponding relationship (i.e., a first correspondence table) between different target thicknesses of the steel strip, target final rolling temperatures, coiling temperatures and speed compensation coefficients, as well as a corresponding relationship (i.e., a second correspondence table) between different steel strip speeds and speed gain coefficients. Then data can be set for the laminar flow cooling apparatus 20 according to the above corresponding relationships (i.e., the first correspondence table and the second correspondence table).

It should be noted that, in some embodiments of the present disclosure, the corresponding relationship between different target thicknesses of the steel strip, target final rolling temperatures, target coiling temperatures and speed compensation coefficients, and the corresponding relationship between different steel strip speeds and speed gain coefficients, can be obtained based on several experimental data.

In some embodiments of the present disclosure, after configuring the above corresponding relationships, a corresponding speed gain coefficient can be sought and obtained according to a target thickness of the steel strip, a target final rolling temperature and a coiling temperature. Similarly, a corresponding speed gain coefficient can be sought and obtained according to a steel strip speed.

In some embodiments of the present disclosure, a speed of the steel strip when it passes through a F1 stand (that is, a first roller in a precision rolling apparatus 10 through which the steel strip passes) may be selected as the steel strip speed.

In some embodiments of the present disclosure, after the above step S20, the steel strip coiling temperature control method may further comprise Step S30, correcting the steel strip speed based on the speed compensation coefficient and the speed gain coefficient to obtain a corrected steel strip speed, as shown in FIG. 2.

Those skilled in the art should understand that the aforementioned speed compensation coefficient means a relative change rate of the steel strip speed during the steel strip throwing process; and the aforementioned speed gain coefficient means an influence rate of the steel strip throwing process on a steel strip speed at different steel strip speeds.

In some embodiments of the present disclosure, a speed compensation coefficient applicable to the current situation is determined according to a target thickness of the steel strip, a target final rolling temperature and a coiling temperature; at this time, a speed gain coefficient applicable to the current situation is determined according to a steel strip speed; and then the speed compensation coefficient and the speed gain coefficient are taken in combination to obtain a speed correction coefficient, and finally a corrected steel strip speed can be calculated and obtained according to the speed correction coefficient. The corrected steel strip speed is used for adjusting the cooling efficiency of the laminar flow cooling apparatus 20.

In some embodiments of the present disclosure, the aforementioned process may be expressed below as:

$$Spd_preAdj=Spd_pre*(1-SpdAdj),$$
$$SpdAdj=SpdComp*SpdGain;$$

wherein, Spd_pre is a steel strip speed; SpdComp is a speed compensation, coefficient; SpdGain is a speed gain coefficient; and Spd_preAdj is a corrected steel strip speed.

In some embodiments of the present disclosure, after step S30, the steel strip coiling temperature control method may further comprise step S40, adjusting a cooling efficiency of the laminar flow cooling apparatus 20 according to the corrected steel strip speed, as shown in FIG. 2.

In the embodiments of the present disclosure, the laminar flow cooling apparatus 20 also needs to be configured with a corresponding relationship between the target thickness of the steel strip, the target final rolling temperature, the coiling temperature, and the strip speed and the cooling efficiency parameter. After the corrected steel strip speed is obtained through the above step S30, the cooling efficiency of the laminar flow cooling apparatus 20 can be adjusted (that is, a cooling water emission load per unit time of the laminar flow cooling apparatus 20 can be adjusted) by combining the target thickness of the steel strip, the target final rolling temperature and the coiling temperature, to adapt to the steel strip speed during the steel strip throwing process.

With the aforementioned method, the cooling efficiency of the laminar flow cooling apparatus 20 can be dynamically adjusted according to the steel strip speed so as to solve the problems that there is a great difference in coiling temperature between a tail section of a steel strip and a front section of the steel strip caused by speed changes during the steel strip throwing process, and thus to reduce an amount of cutting loss of the steel strip and improve production quality of the steel strip.

The applicant found in practical application that when the target thickness of the steel strip is greater than a certain degree, the effect of the steel strip throwing process on the coiling temperature of the tail section of the steel strip will gradually decrease.

Figure 3:
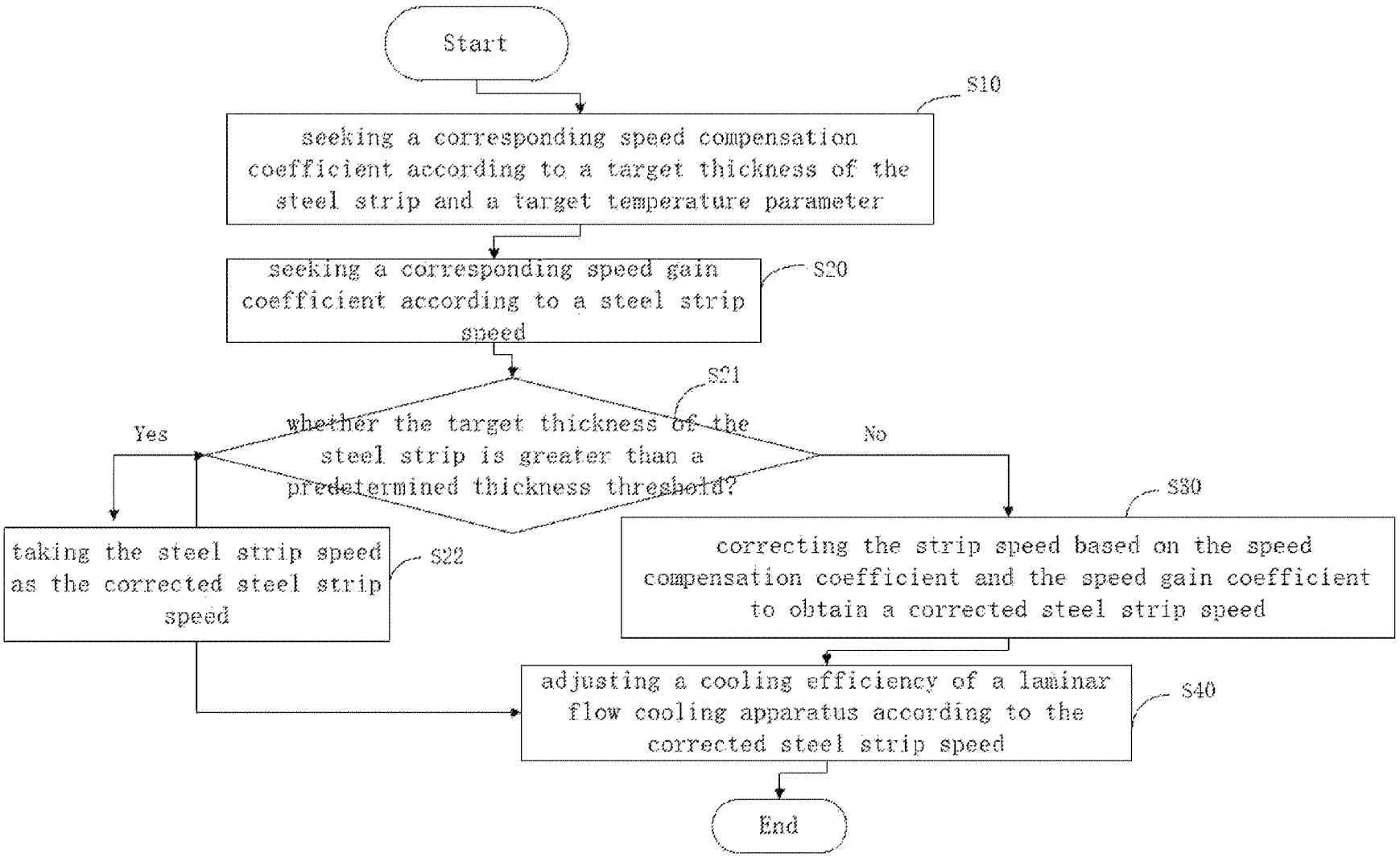
FIG. 3 is a schematic flowchart showing steps of a steel strip coiling temperature control method according to one or more embodiment of the present disclosure.

In some embodiments of the present disclosure, in order to reduce calculation amount of the laminar flow cooling apparatus 20 during the control process and improve response speed of the laminar flow cooling apparatus 20 during the high-speed rolling of the steel strip, a determining step may be added before the above step S30 (as shown in FIG. 3) to determine whether the steel strip speed needs to be corrected.

The steel strip coiling temperature control method according to another embodiment of the present disclosure will be described in detail below with reference to FIG. 3.

Referring to FIG. 3, before step S30, the steel strip coiling temperature control method may further comprise: step S21, comparing the target thickness of the steel strip with a predetermined thickness threshold.

In some embodiments of the present disclosure, the thickness threshold may be set to 5 mm. If the target thickness of the steel strip is less than or equal to 5 mm, the step S30 is executed to perform a correction calculation based on the speed compensation coefficient and the speed gain coefficient obtained in steps S10 and S20, and then the cooling efficiency of the laminar flow cooling apparatus 20 is adjusted according to the corrected steel strip speed.

In some embodiments of the present disclosure, when the target thickness of the steel strip is greater than 5 mm, since the steel strip throwing process has little effect on the coiling temperature of the tail section of the steel strip, the steel strip speed (that is, the speed when the steel strip passes through F1 stand can be directly used as the corrected steel strip speed to control the cooling efficiency of the laminar flow cooling apparatus 20.

In practical applications, the applicant also found that the effect of the target final rolling temperature and the coiling temperature on the cooling efficiency of the laminar flow cooling apparatus 20 depends only on the temperature difference value between the target final rolling temperature and the coiling temperature, and the effect of the target thickness of the steel strip and the steel strip speed on the steel strip coiling temperature within a certain range is acceptable.

In some embodiments of the present disclosure, the corresponding speed compensation coefficient can be obtained according to a grade of the target thickness of the steel strip (i.e., a thickness range) and a grade of temperature difference value (i.e., a range of temperature difference value) between the target final rolling temperature and the coiling temperature, and the corresponding speed gain coefficient can be obtained according to a grade of the steel strip speed (i.e., a speed range), thereby further reducing calculation amount of the laminar flow cooling apparatus 20 during the control process and improving response speed of the laminar flow cooling apparatus 20 during high-speed strip rolling of the steel strip.

In some embodiments of the present disclosure, when a difference between the target final rolling temperature and the coiling temperature deltaT≤100° C., the grade of temperature difference value may be classified as 0; when 100° C.<deltaT≤250° C., the grade of temperature difference value may be classified as 1; when 250° C.<deltaT≤350° C., the grade of temperature difference value may be classified as 2; when 350° C.<deltaT≤450° C., the grade of temperature difference value may be classified as 3; when 450° C.<deltaT≤550° C., the grade of temperature difference value may be classified as 4; when 550° C.<deltaT≤650° C., the grade of temperature difference value may be classified as 5; when deltaT>650° C., the grade of temperature difference value may be classified as 6.

In some embodiments of the present disclosure, if the target thickness of the steel strip h≤1.9 mm, the speed compensation coefficients SpdComp corresponding to the grades of temperature difference value from 0 to 6 are respectively 0.02, 0.03, 0.05, 0.08, 0.09, 0.12, 0.15; if 1.9<h≤2.5 mm, the speed compensation coefficients SpdComp corresponding to the grades of temperature difference value from 0 to 6 are respectively 0.01, 0.02, 0.04, 0.075, 0.085, 0.115, 0.135; if 2.5<h≤3.0 mm, the speed compensation coefficients SpdComp corresponding to the grades of temperature difference value from 0 to 6 are respectively 0.0, 0.015, 0.03, 0.055, 0.08, 0.105, 0.115; if 3.0<h≤4.0 mm, the speed compensation coefficients SpdComp corresponding to the grades of temperature difference value from 0 to 6 are respectively 0.0, 0.01, 0.02, 0.045, 0.075, 0.10, 0.105; if 4.0<h≤5.0 mm, the speed compensation coefficients SpdComp corresponding to the grades of temperature difference value from 0 to 6 are respectively −0.005, 0.005, 0.01, 0.035, 0.055, 0.075, 0.085; if h>5.0 mm, the speed compensation coefficients SpdComp corresponding to the grades of temperature difference value from 0 to 6 are respectively 0.0, 0.0, 0.0, 0.0, 0.0, 0.0, 0.0.

In some embodiments of the present disclosure, if the steel strip speed Spd_pre≤5 m/s, the corresponding speed gain coefficient SpdGain can be set as 0.98; if 5.0<Spd_pre≤7.5 m/s, the corresponding speed gain coefficient SpdGain can be set as 1.0; If 7.5<Spd_pre≤10 m/s, the corresponding speed gain coefficient SpdGain can be set as 1.01; if 10.5<Spd_pre≤12 m/s, the corresponding speed gain coefficient SpdGain can be set as 1.02; if 12.5<Spd_pre≤14 m/s, the corresponding speed gain coefficient SpdGain can be set as 1.03; if 14<Spd_pre≤16 m/s, the corresponding speed gain coefficient SpdGain can be set as 1.035; if Spd_pre>16 m/s, the corresponding speed gain coefficient SpdGain can be set as 1.045.

In some embodiments of the present disclosure, an upper limit and a lower limit of the above speed correction coefficient may be set. For example, in some embodiments, the upper limit of the speed correction, coefficient may be set to 0.15 and the lower limit of the speed correction coefficient may be set to −0.1. When a product of the speed compensation coefficient and the speed gain coefficient is greater than 0.15, the speed correction coefficient is set to 0.15; and when a product of the speed compensation coefficient and the speed gain coefficient is less than −0.1, the speed correction coefficient is set to −0.1.

It should be understood that the above parameters are only data provided by the preferred embodiments of the present disclosure. In other embodiments of the present disclosure, the corresponding relationship between the above parameters may be arbitrarily adjusted according to actual application.

In summary, compared with the prior art, the steel strip coiling temperature control method according to the embodiments of the present disclosure has the following technical effects or advantages:

1. The steel strip coiling temperature control method according to the embodiments of the present disclosure determines a speed compensation coefficient according to a target thickness of the steel strip, a target final rolling temperature and a coiling temperature, and determines a speed gain coefficient according to a steel strip speed, then corrects the steel strip speed according to the speed compensation coefficient and the speed gain coefficient so as to obtain a corrected steel strip speed, and finally adjusts a cooling efficiency of the laminar flow cooling apparatus 20 according to the corrected steel strip speed. With this method, the cooling efficiency of the laminar flow cooling apparatus 20 can be dynamically adjusted according to the steel strip speed, thereby solving the problems that there is a great difference in coiling temperature between a tail section of the steel strip and a front section of the steel strip caused by a steel strip throwing process, and reducing the amount of cutting loss of the steel strip.

2. With the steel strip coiling temperature control method provided in the embodiments of the present disclosure, by setting a step of determining whether a speed correction step is needed, the corresponding relationship among the target thickness of the steel strip, the target final rolling temperature, the coiling temperature and the speed compensation coefficient as well as the corresponding relationship between the steel strip speed and the speed gain coefficient are set as a corresponding relationship between surfaces and points (that is, the target thickness of the steel strip, the temperature difference value between the target final rolling temperature and the coiling temperature, and the strip rolling speed are classified into different grades), thereby reducing the calculation amount of the laminar flow cooling apparatus 20 during the control process and thus improving the response speed of the laminar flow cooling apparatus 20 during the high-speed strip rolling process of the steel strip.

In another aspect, the embodiments of the present disclosure also provide a laminar flow cooling apparatus 20 that implements the steel strip coiling temperature control method described in the embodiments of the present disclosure.

Referring to FIG. 4, the laminar flow cooling apparatus 20 comprises a storage 21, a storage controller 22 and a processor 23. The storage 21 comprises a steel strip coiling temperature control device 70.

The storage 21, the storage controller 22, and the processor 23 are directly or indirectly electrically connected to each other to implement data transmission or interaction. For example, these components can be electrically connected to each other through one or more communication buses or signal lines. The steel strip coiling temperature control device 70 may comprise at least one software function module stored in the storage 21 in the form of software or firmware or solidified in an operating system (OS) of the laminar flow cooling apparatus 20. The processor 23 is configured to execute an executable module stored in the storage 21, such as a software function module and a computer program contained in the steel strip coiling temperature control device 70. The storage controller 22 is configured to store a data table structure and data values of a first correspondence table and a second correspondence table contained in the steel strip coiling temperature control device 70.

In some embodiments of the present disclosure, the laminar flow cooling apparatus 20 is configured with a first correspondence table and a second correspondence table; wherein the first correspondence table is configured with speed compensation coefficients corresponding to target thicknesses of the steel strip and target temperature parameters, and the second correspondence table is configured with speed gain coefficients corresponding to steel strip speeds.

Figure 5:
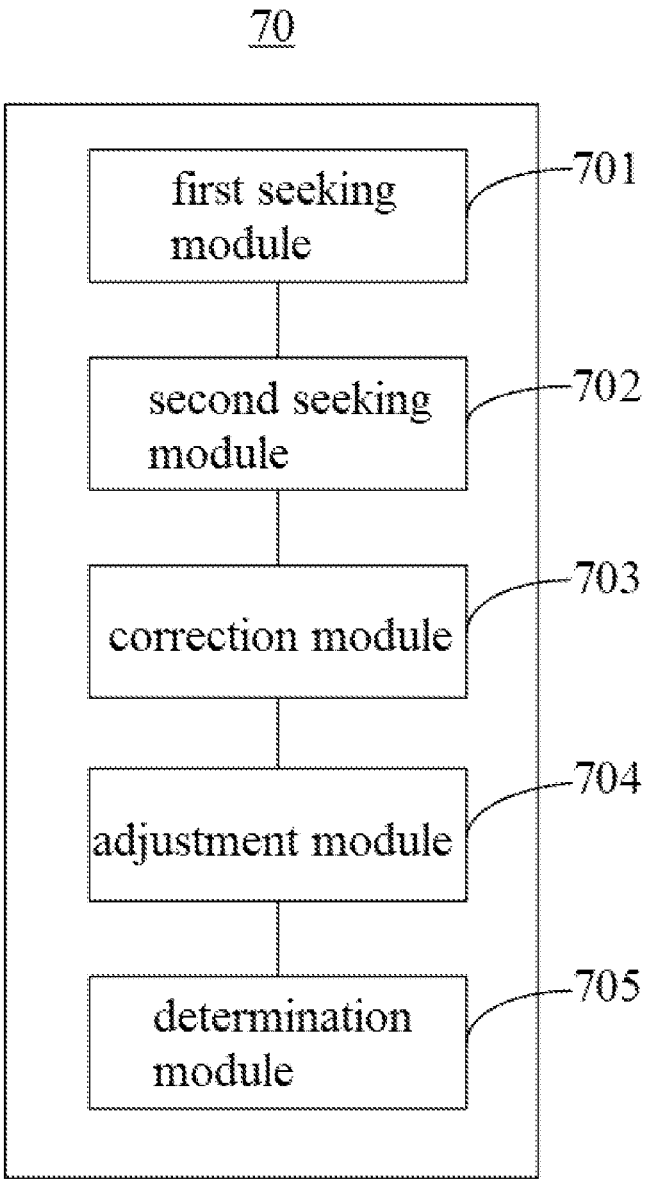
FIG. 5 is a schematic block diagram showing a steel strip coiling temperature control device according to one or more embodiments of the present disclosure.

Referring to FIG. 5, the steel strip coiling temperature control device 70 comprises: a first seeking module 701 configured to seek a corresponding speed compensation coefficient from the first correspondence table according to a target thickness of a steel strip and a target temperature parameter, and the target temperature parameter comprises a target final rolling temperature and a coiling temperature; a second seeking module 702 configured to seek a corresponding speed gain coefficient from the second correspondence table according to a steel strip speed; a correction module 703 configured to correct the steel strip speed based on the speed compensation coefficient and the speed gain coefficient to obtain a corrected steel strip speed; and an adjustment module 704 configured to adjust a cooling efficiency of the laminar flow cooling apparatus 20 according to the corrected steel strip speed.

In some embodiments of the present disclosure, the steel strip coiling temperature control device 70 further comprises a determination module 705, and the determination module 705 is configured for: comparing the target thickness of the steel strip with a predetermined thickness threshold; performing the step of correcting the steel strip speed based on the speed compensation coefficient and the speed gain coefficient if the target thickness of the steel strip is less than or equal to the predetermined thickness threshold, to obtain the corrected steel strip speed; and taking the steel strip speed as the corrected steel strip speed if the target thickness of the steel strip is greater than the predetermined thickness threshold.

In some embodiments of the present disclosure, the laminar flow cooling apparatus 20 is further configured with a third correspondence table. The third correspondence table is configured with cooling efficiency parameters corresponding to target thicknesses of the steel strip, target temperature parameters and steel strip speeds.

In some embodiments of the present disclosure, the adjustment module 704 is configured for: seeking a corresponding cooling efficiency parameter from the third correspondence table according to a corrected steel strip speed, a target thickness of the steel strip and a target temperature parameter; and adjusting a cooling water emission load of the laminar flow cooling apparatus 20 according to the cooling efficiency parameter.

Since the laminar flow cooling apparatus 20 described in the present disclosure is a laminar flow cooling apparatus 20 used for implementing the steel strip coiling temperature control method in the embodiments of the present disclosure, a person skilled in the art would learn specific implementations of the laminar flow cooling apparatus 20 of the present embodiments and various variations thereof based on the steel strip coiling temperature control method introduced in the embodiments of the present disclosure. Therefore, how to use the laminar flow cooling apparatus 20 to implement the method in the embodiments of the present disclosure will not be described in detail. As long as a laminar flow cooling apparatus 20 is used by a person skilled in the art to implement the steel strip coiling temperature control method in the embodiments of the present disclosure, it belongs to the protection scope of the present disclosure.

In addition, some embodiments of the present disclosure also provide a steel strip processing system. The system comprises a steel strip precision rolling apparatus 10, a laminar flow cooling apparatus 20, and a strip coiling apparatus 30. The laminar flow cooling apparatus 20 is provided between the steel strip precision rolling apparatus 10 and the strip coiling apparatus 30, and configured to cool the steel strip processed by the steel strip precision rolling apparatus 10. The laminar flow cooling apparatus 20 comprises a storage 21 and a processor 23. The storage 21 is configured to store a computer program, and the processor 23 is configured to load and execute the computer program so that the laminar flow cooling apparatus 20 can perform the steel strip coiling temperature control method as described above.

For the same reasons as mentioned above, how to use the laminar flow cooling apparatus 20 to implement the method according to the embodiments of the present disclosure will not be described in detail.

Those skilled in the art should understand that the embodiments of the present invention may be provided as embodiments of methods, systems, or computer program products. Therefore, the present disclosure may adopt the form of an entirely hardware embodiment, an entirely software embodiment, or an embodiment combining software and hardware. Moreover, the present disclosure may adopt the form of a computer program product implemented on one or more computer usable storage media (including but not limited to disk storage, CD-ROM, optical storage, etc.) containing computer usable program code.

The present invention is described with reference to flowcharts and/or block diagrams of methods, apparatus (systems), and computer program products according to embodiments of the present disclosure. It should be understood that each step and/or block in the flowchart and/or block diagram, and any combination of step(s) and/or block(s) in the flowchart and/or block diagram, may be implemented by computer program instructions. These computer program instructions can be provided to a processor of a general-purpose computer, a special-purpose computer, an embedded processing machine, or other programmable data processing apparatus to produce a machine so that the instructions executed by the processor of the computer or other programmable data processing apparatus may create a machine(s) for realizing, the functions designated in step(s) in the flowchart and/or block(s) in the block diagram.

These computer program instructions may also be stored in a computer-readable storage that can guide a computer or other programmable data processing device to work in a specific manner, so that the instructions stored in the computer-readable storage may create an article of manufacture including an instruction device, and the instruction device implements the functions designated in step(s) in the flowchart and/or block(s) in the block diagram.

These computer program instructions can also be loaded onto a computer or other programmable data processing apparatus, so that a series of operating steps are performed on the computer or other programmable apparatus to produce computer-realized process, so that the instructions executed on the computer or other programmable apparatus may provide steps for implementing the functions designated in step(s) in the flowchart and/or block(s) in the block diagram.

The above-mentioned embodiments are only specific implementations of the present disclosure to illustrate the technical solutions of the present disclosure and not to limit the scope of the claims provided herein, and the protection scope of the present disclosure is not limited thereto. Although the present disclosure has been described in detail with reference to the foregoing embodiments, a person of ordinary skill in the art should understand that any person skilled in the art can still modify the technical solutions described in the foregoing embodiments or easily think of changes, or some of the technical features can be equivalently replaced, within the technical scope disclosed in this application. These modifications, changes, or substitutions do not make the essence of the corresponding solutions deviate from the spirit and scope of the technical solutions of the embodiments of the present disclosure, and should be covered by the scope of the present disclosure. Therefore, the protection scope of the present disclosure shall be subject to the protection scope of the claims.

The invention claimed is:

1. A steel strip coiling temperature control method used in a laminar flow cooling apparatus, the laminar flow cooling apparatus comprising a memory device having stored thereon a first correspondence table and a second correspondence table;

wherein the first correspondence table comprises speed compensation coefficients, wherein the speed compensation coefficients indicate a relative change rate of a steel strip speed during a steel strip throwing process, and correspond to target thicknesses of a steel strip and target temperature parameters through experimental data, and the second correspondence table comprises speed gain coefficients, wherein the speed gain coefficients indicate an influence rate of the steel strip throwing process on a steel strip speed at different initial steel strip speeds and correspond to the initial steel strip speeds through the experimental data;

and wherein, the steel strip coiling temperature control method comprises:

looking up a corresponding speed compensation coefficient from the first correspondence table according to a target thickness of a steel strip and a target temperature parameter, and wherein the target temperature parameter comprises a target final rolling temperature and a coiling temperature;

looking up a corresponding speed gain coefficient from the second correspondence table according to an initial steel strip speed;

correcting the steel strip speed based on the speed compensation coefficients and the speed gain coefficients to obtain a corrected steel strip speed;

wherein, the correcting the steel strip speed based on the speed compensation coefficients and the speed gain coefficients is performed according to a formula:

$$Spd_preAdj=Spd_pre*(1-SpdAdj),$$
$$SpdAdj=SpdComp*SpdGain;$$

wherein, Spd_pre indicates the initial steel strip speed; SpdComp indicates the speed compensation coefficient; SpdGain indicates the speed gain coefficient; and Spd_preAdj indicates the corrected steel strip speed; and increasing or decreasing a cooling efficiency of the laminar flow cooling apparatus according to the corrected steel strip speed.

2. The method of claim 1, wherein before the step of correcting the steel strip speed based on the speed compensation coefficients and the speed gain coefficients, the method further comprises:

comparing the target thickness of the steel strip with a predetermined thickness threshold;

performing the step of correcting the steel strip speed based on the speed compensation coefficients and the speed gain coefficients if the target thickness of the steel strip is less than or equal to the predetermined thickness threshold, to obtain the corrected steel strip speed; and taking the steel strip speed as the corrected steel strip speed if the target thickness of the steel strip is greater than the predetermined thickness threshold.

3. The method of claim 1, wherein the step of looking up the corresponding speed compensation coefficients from the first correspondence table according to a target thickness of a steel strip and a target temperature parameter comprises:

determining a grade of thickness to which the target thickness of the steel strip belongs according to a corresponding relationship between a predetermined target thicknesses of the steel strip and a grade of thickness;

calculating a temperature difference value between the target final rolling temperature and the coiling temperature;

determining a grade of temperature difference value corresponding to the target temperature parameter according to a corresponding relationship between the predetermined temperature difference values and the grade of temperature difference values; and determining the speed compensation coefficients according to the grade of thickness and the grade of temperature difference value.

4. The method of claim 1, wherein the step of looking up a corresponding speed gain coefficient from the second correspondence table according to the initial steel strip speed comprises:

obtaining a steel strip speed when a tail section of the steel strip reaches a F1 stand, wherein the F1 stand is the first roller in a precision rolling apparatus through which the steel strip passes; and looking up the speed gain coefficient corresponding to the initial steel strip speed when the tail section of the steel strip reaches the F1 stand from the second correspondence table.

5. The method of claim 1, wherein the step of correcting the steel strip speed based on the speed compensation coefficients and the speed gain coefficients comprises:

taking a product of the speed compensation coefficient and the speed gain coefficient as a speed correction coefficient; and calculating based on the speed correction coefficients and the steel strip speed to obtain the corrected steel strip speed.

6. The method of claim 1, wherein the memory device has further stored thereon a third correspondence table, and the third correspondence table comprises cooling efficiency parameters corresponding to target thicknesses of the steel strip, target temperature parameters, and steel strip speeds obtained through experimental data;

the step of increasing or decreasing a cooling efficiency of the laminar flow cooling apparatus according to the corrected steel strip speed comprises:

looking up a corresponding cooling efficiency parameter from the third correspondence table according to the corrected steel strip speed, the target thickness of the steel strip and the target temperature parameter; and increasing or decreasing a cooling water emission load of the laminar flow cooling apparatus according to the cooling efficiency parameters.

7. A steel strip coiling temperature control device, comprising a processor configured to implement the method according to claim 1.

8. The device of claim 7, wherein the processor is further configured to perform:

comparing the target thickness of the steel strip with a predetermined thickness threshold;

correcting the steel strip speed based on the speed compensation coefficients and the speed gain coefficients if the target thickness of the steel strip is less than or equal to the predetermined thickness threshold to obtain the corrected steel strip speed; and taking the steel strip speed as the corrected steel strip speed if the target thickness of the steel strip is greater than the predetermined thickness threshold.

9. The device of claim 7, wherein the memory device has further stored thereon a third correspondence table, and the third correspondence table comprising cooling efficiency parameters corresponding to target thicknesses of the steel strip, target temperature parameters and steel strip speeds obtained through experimental data;

and wherein the processor is further configured to perform:

looking up a corresponding cooling efficiency parameter from the third correspondence table according to the corrected steel strip speed, the target thickness of the steel strip and the target temperature parameter; and increasing or decreasing a cooling water emission load of the laminar flow cooling apparatus according to the cooling efficiency parameter.

10. A steel strip processing system, comprising:

a steel strip precision rolling apparatus, a laminar flow cooling apparatus, and a steel strip coiling apparatus;

wherein the laminar flow cooling apparatus is provided between the steel strip precision rolling apparatus and the steel strip coiling apparatus, and is configured to cool a steel strip processed by the steel strip precision rolling apparatus;

and wherein, the laminar flow cooling apparatus comprises a storage and a processor;

the storage is configured to store a computer program; and the processor is configured to load and execute the computer program so as to enable the laminar flow cooling apparatus to perform the steel strip coiling temperature control method as claimed in claim 1.

* * * * *